US007677614B2

(12) United States Patent
Mönig

(10) Patent No.: US 7,677,614 B2
(45) Date of Patent: Mar. 16, 2010

(54) DEVICE FOR OPERATING LOCKS ON DOORS OR HATCHES OF VEHICLES

(75) Inventor: Stefan Mönig, Schwelm (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 454 days.

(21) Appl. No.: 11/632,589

(22) PCT Filed: Jun. 21, 2005

(86) PCT No.: PCT/EP2005/006653

§ 371 (c)(1),
(2), (4) Date: Jan. 17, 2007

(87) PCT Pub. No.: WO2006/015655

PCT Pub. Date: Feb. 16, 2006

(65) Prior Publication Data

US 2008/0028885 A1 Feb. 7, 2008

(30) Foreign Application Priority Data

Aug. 5, 2004 (DE) ..... 10 2004 037 983

(51) Int. Cl.
*E05B 3/00* (2006.01)
*E05B 7/00* (2006.01)

(52) U.S. Cl. ..... 292/336.3

(58) Field of Classification Search ..... 16/412; 292/336.3, DIG. 27, DIG. 61, DIG. 65
See application file for complete search history.

(56) References Cited

U.S. PATENT DOCUMENTS 3,153,552 A * 10/1964 Sandor ..... 292/336.3
3,159,415 A * 12/1964 Sandor ..... 292/336.3
4,475,754 A * 10/1984 Arlauskas et al. ..... 292/336.3
5,092,642 A * 3/1992 Lindmayer et al. ..... 292/336.3
5,975,597 A * 11/1999 Makiuchi et al. ..... 292/336.3
6,007,122 A * 12/1999 Linder et al. ..... 292/336.3

(Continued)

FOREIGN PATENT DOCUMENTS

DE 101 55 340 5/2001

(Continued)

*Primary Examiner*—Peter M Cuomo
*Assistant Examiner*—Alyson M Merlino
(74) *Attorney, Agent, or Firm*—Friedrich Kueffner

(57) ABSTRACT

In a device for operating locks (16) on doors or hatches of vehicles, a fixed support (10) is a arranged on the door. A moving unit (20) is mounted (11, 12), such as to pivot on the support (10), belonging to which is at least one handle (21). Spring loading (25, 26) ensures the unoperated moving unit (20) is held in a flat rest position on the support (10). On operating the handle, the moving unit (20) must be pivoted against said spring loading, whereby the lock (16) is operated. A damping unit (30) ensures that the returning moving unit (20) pivoting action is decelerated. A reliable, economical damping unit (30) is obtained, whereby an elastic body (31) is arranged in at least one position on the moving unit (20) which extends outwards with a projection (32). On the return movement (39) into the rest position the extending projection (32) is deformed against a fixed counter-surface (40), whereupon the movement energy is largely dissipated. On reaching the rest position, the deformed projection (32) is supported against the counter-surface (40).

14 Claims, 4 Drawing Sheets

U.S. PATENT DOCUMENTS

| | | | | |
|---|---|---|---|---|
| 6,234,041 | B1 | 5/2001 | Larabet et al. | |
| 6,378,921 | B1 * | 4/2002 | Deischl et al. | 292/336.3 |
| 6,572,159 | B2 * | 6/2003 | Lambertz et al. | 292/336.3 |
| 6,594,864 | B2 * | 7/2003 | Epp et al. | 16/438 |
| 6,619,709 | B1 * | 9/2003 | Monig et al. | 292/336.3 |
| 6,871,887 | B2 * | 3/2005 | Jooss et al. | 292/336.3 |
| 2006/0143868 | A1 * | 7/2006 | Bauer | 16/438 |

FOREIGN PATENT DOCUMENTS

| | | |
|---|---|---|
| DE | 100 30 331 | 1/2002 |
| EP | 0 995 870 | 4/2000 |
| EP | 1 136 640 | 9/2001 |

* cited by examiner

DEVICE FOR OPERATING LOCKS ON DOORS OR HATCHES OF VEHICLES

BACKGROUND OF THE INVENTION

The invention pertains to a device for actuating locks of doors or hatches of vehicles. The damping mechanism has the task of slowing down the return movement of the movable unit, thus damping the contact noise which is produced when the actuated movable unit of the device is released and returns to its rest position under the action of its spring-loading.

In the known device of this type, a piston-cylinder unit is used as a damping mechanism; the medium which fills the cylinder of this piston-cylinder unit is ambient air (DE 100 30 331 A1). One end of this unit moves along with the handle, whereas the other end is connected to the bracket. This damping device has proven reliable, but it is expensive and bulky.

It is known in devices of another type that intermediate layers of rubber can be provided on the stationary exterior panel of the door or hatch; when the handle is actuated, it strikes these intermediate layers. The intermediate layer of rubber, however, does not slow down the pivoting return movement; instead, it merely serves to protect the paint of the exterior panel and also acts as a seal.

SUMMARY OF THE INVENTION

The invention is based on the task of developing a reliable and inexpensive device for actuating locks of doors or hatches of vehicles which is characterized by a space-saving design. This is achieved according to the invention by an actuating device having at least one element of elastomeric material that is seated in at least one location on a movable unit and pivots along with the unit when the handle is actuated, to which the following special meaning attaches.

The inventive elastomeric element is a component of the movable unit and therefore moves along with the handle when the handle is actuated. A stationary opposing surface is provided on the bracket. As soon as the movable unit starts its return movement, the free section of the elastomeric element meets this opposing surface and is deformed by it, as a result of which kinetic energy is transformed into the work of deformation. In its rest position, the free section is in a state of maximum deformation against the opposing surface.

It is especially advantageous to design the elastomeric element as a flexible bar, which is bent by the opposing surface when the movable unit approaches its rest position. The rebound energy to be damped is then absorbed by the work expended to bend the flexible bar. If the bar is long enough and the opposing surface is in a suitable position, the bending begins so soon that all of the excess energy is consumed by the time the movable unit reaches its rest position.

It is recommended that the flexible bar be installed in the area of a reversing lever supported independently on the bracket. When actuated, the handle acts on this lever, which then transmits the motion of the handle to the lock.

BRIEF DESCRIPTION OF THE DRAWING

Additional measures and advantages of the invention can be derived from the subclaims, from the following description, and from the drawing. The drawing illustrates the invention on the basis of two exemplary embodiments:

DETAILED DESCRIPTION OF THE INVENTION

Figure 1:
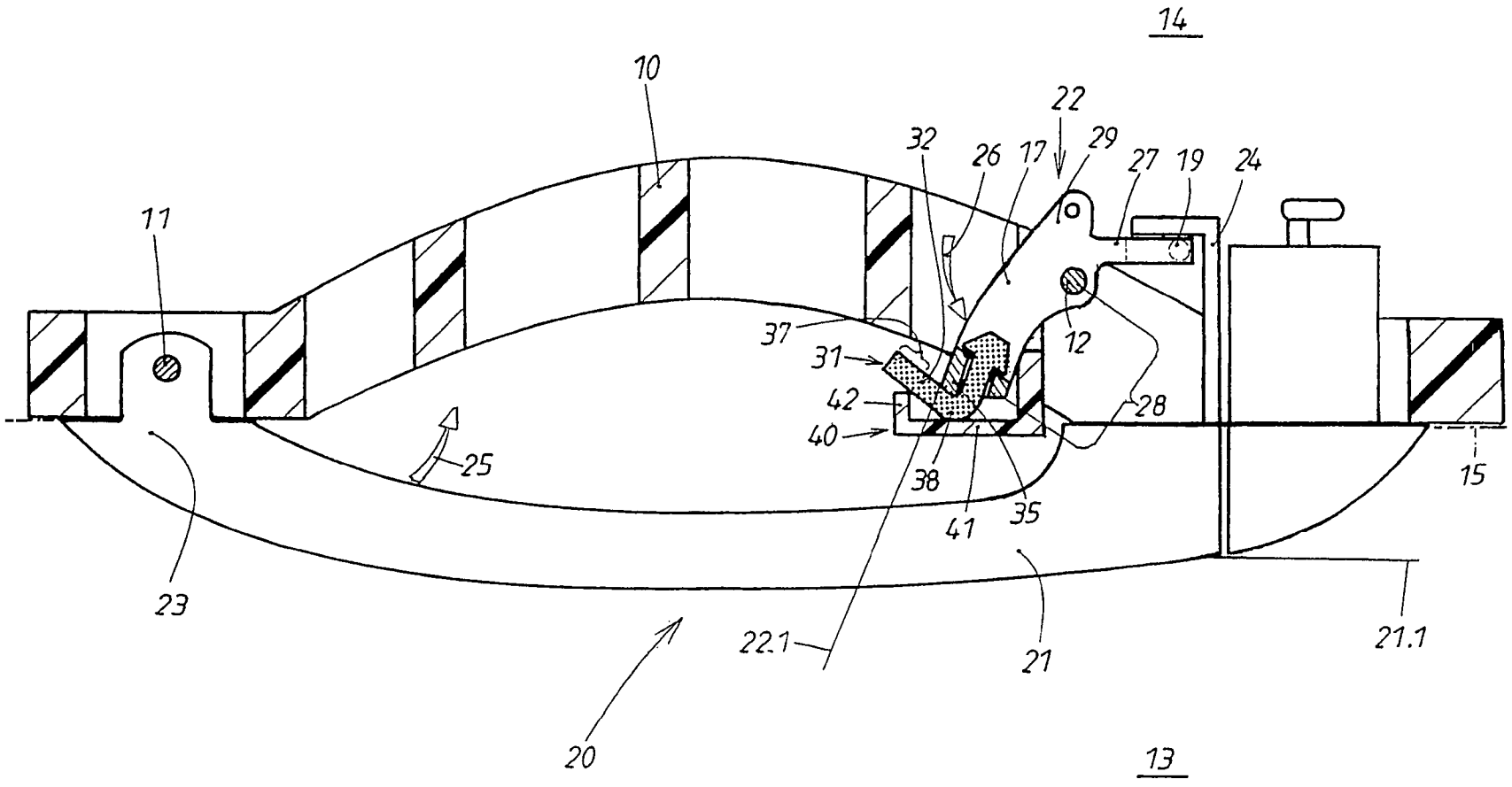
FIG. 1 shows a schematic, longitudinal cross section through an inventive device before it has been installed in the door of a vehicle, where the movable unit, which is pivotably supported on a bracket, is in its rest position.
Figure 2:
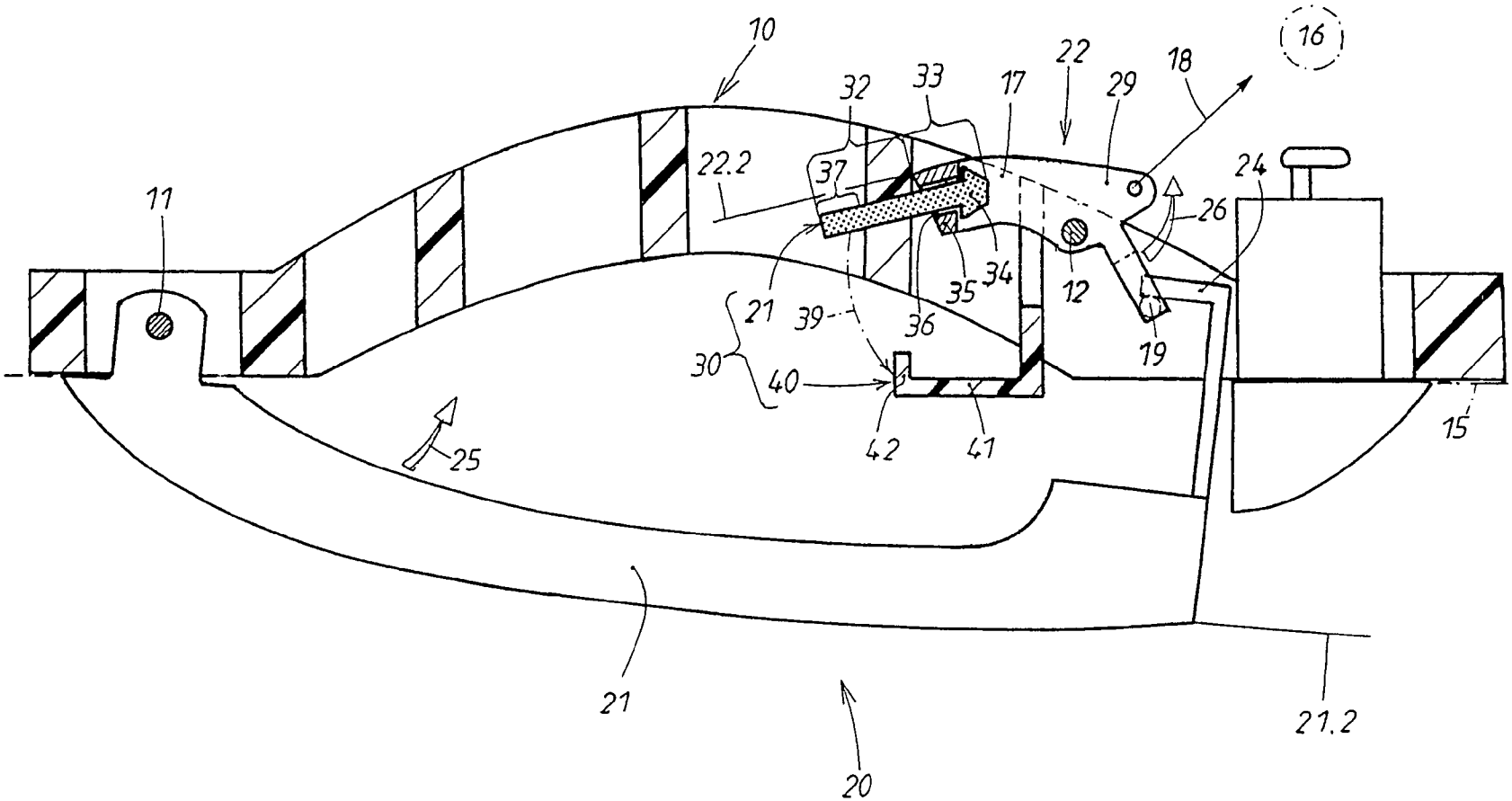
FIG. 2 shows a longitudinal cross section through the same device as that of FIG. 1 after the movable unit has been pivoted into its working position.

In the diagrams of FIGS. 1 and 2, the components of the inventive device are illustrated merely in schematic fashion. The device includes, first, a bracket 10, which is to be attached to the interior of a vehicle door and which, after it has been attached, remains stationary and is covered for the most part by an exterior door panel, indicated in dash-dot line. This bracket has at least two pivot bearings 11, 12 for two parts 21, 22 of a movable structural unit 20, which is referred to in the following in short as the "movable unit". This movable unit consists of a handle 21, arranged essentially on the exterior side 13 of the door in front of the panel 15, and a reversing lever 22, installed in the interior 14 of the door.

The handle 21 can be mounted from the exterior 13 of the door. For this purpose, the handle 21 has bearing points at one end 23, which are mounted in the pivot bearing 11 of the bracket 10. The other end of the handle has an extension 24, which has the task of cooperating with the reversing lever 22 when the handle is actuated. The handle 21 is spring-loaded 25, although the spring elements responsible for this are not shown. This spring-loading 25 can also be generated elsewhere, e.g., in the area of the reversing lever 22. The spring-loading 25 tries to keep the handle 21 in its rest position, indicated by the auxiliary line 21.1 in FIG. 1.

The reversing lever 22 is also spring-loaded, as illustrated by the force arrow 26 in FIG. 1; the means used for this spring-loading can-be the same as that for the spring-loading 25 of the handle 21, as previously mentioned. The reversing lever 22 is pivotably supported on the previously mentioned second pivot bearing 12 of the bracket 10. The spring-loading 26 tries to keep the reversing lever in the rest position illustrated by the auxiliary line 22.1 seen in FIG. 1. The rest position can be determined by stops, which are not shown.

The reversing lever 22 is divided into several arms. The first arm 27 has an engagement point 19 for the previously described extension 24 of the handle. There is an additional arm 29, which has an engagement point for a connection, illustrated schematically by an arrow 18 in FIG. 2, with a lock 16 (not shown). Finally, the reversing lever 22 also has a counterweight 17, as identified in FIGS. 1 and 2, which functions as a third lever arm.

In FIG. 2, the handle has been actuated manually against the action of the two previously mentioned spring-loadings 25, 26 and is located in its working position, identified by the auxiliary line 21.2. Because of the connection between the extension 24 and the engagement point 19, the reversing lever is pivoted around the pivot bearing 12 at the same time that the handle 21 is pivoted around its pivot bearing 11. In FIG. 2, the reversing lever 22 is in its working position, marked by the auxiliary line 22.2.

When the handle 21, which has been actuated in FIG. 2, is released, the spring-loadings 25, 26 ensure that the two components 21, 22 of the movable unit 20 are pivoted back into their rest positions 21.1 and 22.1, respectively, of FIG. 1. Because the springs in FIG. 2 are under even greater tension than they are in FIG. 1, the movable unit 20 would travel back with great force and thus cause a very unpleasant contact sound. This return movement can also cause damage to the paint or to adjacent components.

To prevent that, the invention proposes a damping mechanism 30, which occupies only a small amount of space and is inexpensive to manufacture. It is sufficient to connect one end of an elastomeric element 31 permanently to one of the components 21, 22. The free section 32 of the elastomeric element at the other end projects outward so that it can be deformed. This deformation is caused by the opposing surface 40, which is a stationary component of the bracket 10. In the present case, the damping mechanism 30 is designed in the following way, best seen in FIG. 2.

A flexible bar 31 is used as the elastomeric element. In the present case, this bar is seated on the reversing lever. The previously mentioned ballast arm 28, formed by the counterweight 17, is used as the mounting site. Two lateral projections 35 are provided on the counterweight 17. A slot 36 is thus present between the projections. The bar is attached by its inner mounting section 33; this inner section has a headpiece 34, which fits in the slot 36. The headpiece 34 of the bar projects out from the slot 36 and rests against the contact surfaces of the two projections 35. After the bar has been mounted as shown in FIG. 2, the free section 32 of the flexible bar 31 projects freely out, as also shown in FIG. 2.

The opposing surface 40 belonging to the inventive damping mechanism 30 has the shape of an "L", as FIG. 2 shows. The L-shaped opposing surface 40 consists of a stop section 41 seated on the bracket 10 and a bending section 42, extending at an angle to the first section. The damping mechanism 30 goes into action when, after manual actuation, the handle 21 is released and, as a result of its spring-loading 25 or 26, travels back to the rest positions 21.1 and 22.1 along the path illustrated in dash-dot line in FIG. 2. The result can be seen in FIG. 1.

On the return path 39, the free end 37 of the flexible bar 21 first strikes the upper edge of the bending section 42, as a result of which a bending process is initiated in the free section 32 of the bar. As a result of this deformation of the flexible bar 31, the kinetic energy of the two jointly returning parts 21, 22 of the movable unit 20 is absorbed. The flexible bar 31 is bent around the outer projection 35, as a result of which, during the final phase of the deformation, an arch 38 is formed. In the rest position 22.1, the arch 38 comes to rest against the previously mentioned stop section 41 of this L-shaped opposing surface 40.

The length of the projecting section 32 of the flexible bar 31 is coordinated with the position of the L-shaped opposing surface 40 in such a way that, by the time that the rest position is reached, essentially all of the kinetic energy of the unit 21, 22 has been consumed. The return movement 39 is therefore so strongly decelerated that, when the rest position 22.1 is reached, the unit 21, 22 has almost completely stopped moving. The arch 38 of the flexible bar 31 touches the stop section 41 very gently. The sound of their impact is almost completely suppressed. The section 32 of the bar cooperating with the L-shaped opposing surface 40 wraps around the impacting end of the ballast arm 28 in the area of the projection 35. The end of the ballast arm is thus cushioned by the flexible bar.

Figure 3:
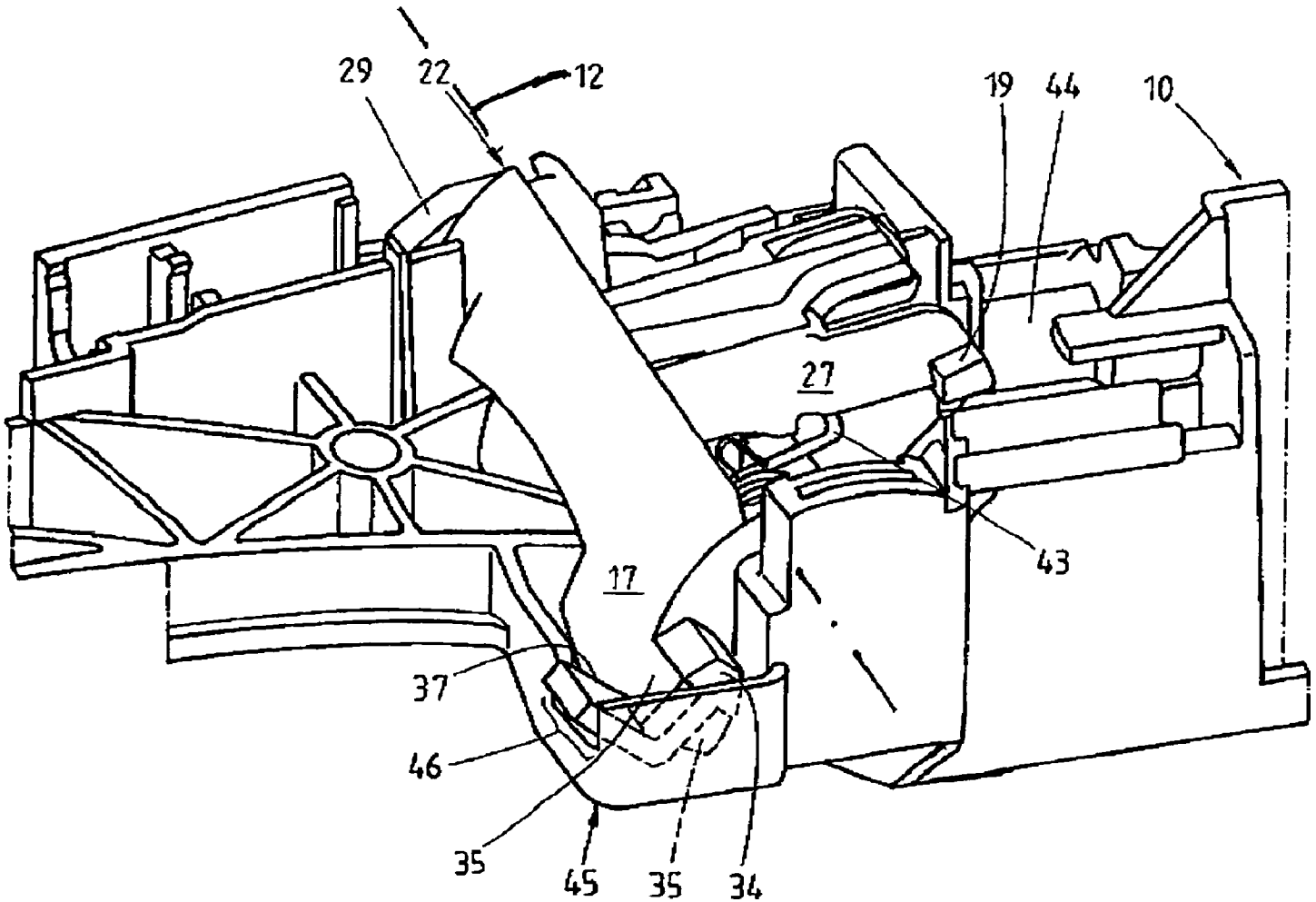
FIG. 3 shows a perspective view of part of a concrete design of the inventive device with the movable unit in its rest position, several components of the device having been omitted.
Figure 4:
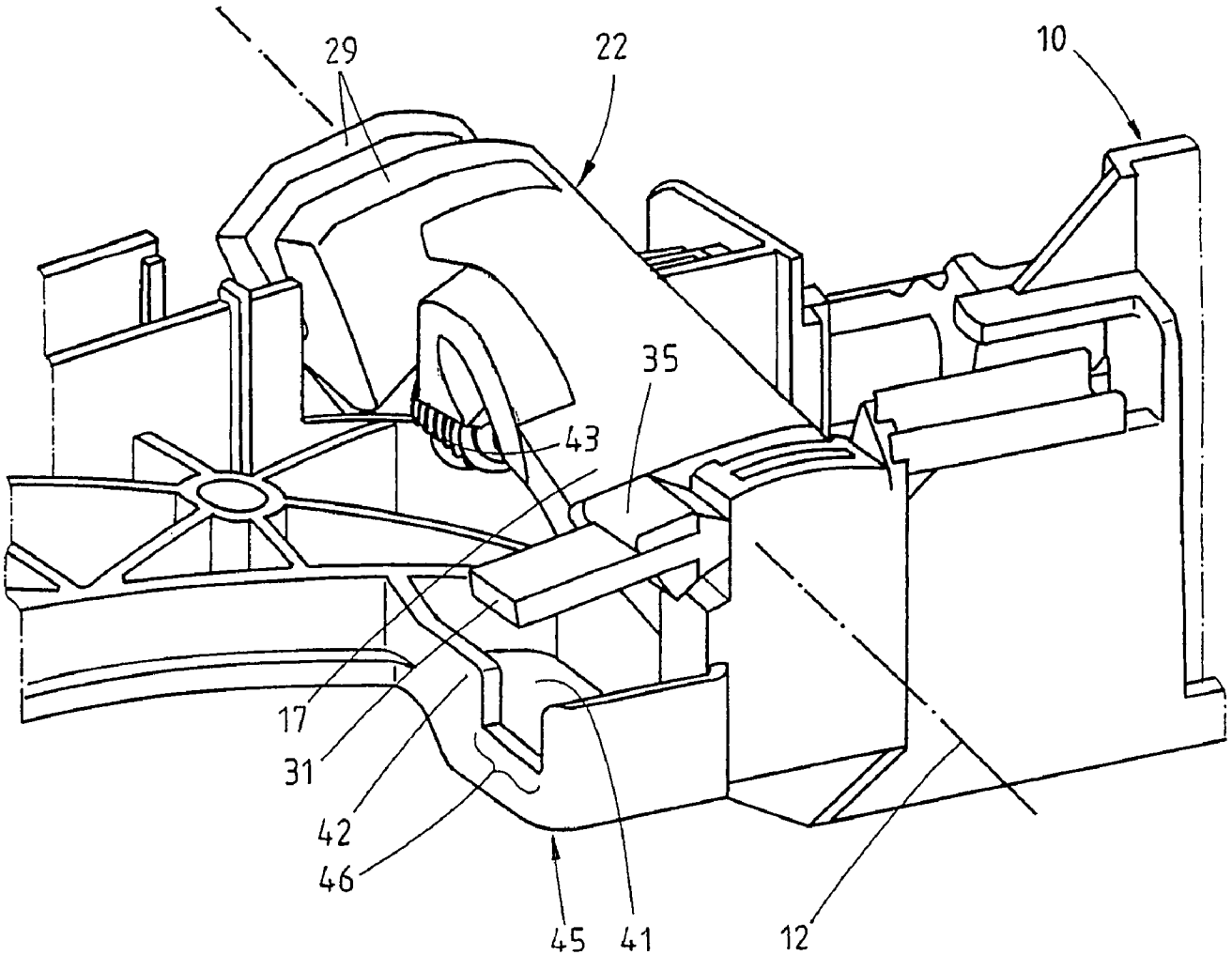
FIG. 4 shows the same device in its working position.

As previously mentioned, a concrete design of the inventive device is illustrated in FIGS. 3 and 4. The position of the pivot bearing axis 12 of the reversing lever 22 is shown in dash-dot line. A torsion spring 43 is wrapped around the axis 12. The spring generates the spring-loadings 25, 26 explained in conjunction with FIGS. 1 and 2. The handle, however, has not yet been mounted in the bracket of FIGS. 3 and 4. Therefore, we see a free through-opening 44 on the side of the bracket 10 where the previously mentioned extension 24 of the handle of FIGS. 1 and 2 will fit. An extension 24 of this type would cooperate with the engagement surface 19 of the actuating arm 27 visible in FIG. 3. To the extent that the same reference numbers have been entered here, the previous description also applies. It is enough merely to discuss the additional, as yet unexplained details.

A shell part 45 is formed on the bracket; the interior of this shell forms the previously described L-shaped opposing surface. Thus the bottom of the shell visible in FIG. 4 fulfills the task of the previously described stop section 41, whereas the outer edge of the shell functions as the bending section 42. The sidewall is provided with a cut-out 46, which conforms to the rectangular profile of the flexible bar 31. After it has been deformed, the bent-over free end 37 of the bar comes to rest in this cut-out 46.

If the deformation work of the flexible bar 31 required to absorb the energy of the return movement is not sufficient, it is possible to increase the length of the projecting section 32 of the bar and to provide the opposing surface 40 with numerous wall sections, which cause the bar to bend at multiple points. It is also possible to vary the profile of the bar along its length to ensure that, during each phase of the return movement 39, the correct amount of kinetic energy is absorbed.

Finally, it is also conceivable that the elastomeric element, i.e., the flexible bar 31, could also be used for a moderate stop position of the movable unit 20 in its working positions 21.2 and 22.2. For this purpose, it would be enough to arrange a suitable opposing surface (not shown) on the bracket, against which the elastomeric element or the flexible bar would come to rest.

LIST OF REFERENCE NUMBERS

10 bracket
11 pivot bearing for 20
12 pivot bearing for-22, pivot axis
13 exterior of door
14 interior of door
15 exterior panel of door
16 lock (also FIG. 2)
17 counterweight at 28
18 arrows of the connection of 29 with 16 (FIG. 2)
19 engagement point for 24 of 20
20 movable unit consisting of 21, 22
21 part of 20, handle
21.1 rest position of 21 (FIG. 1)
21.2 working position of 21 (FIG. 2)
22 part of 20, reversing lever
22.1 rest position of 22 (FIG. 1)
22.2 working position of 22 (FIG. 2)
23 bearing point end of 21
24 extension on 21
25 spring-loading of 21
26 spring-loading of 22
27 first arm of 22, actuating arm for 19
28 third arm of 22, ballast for 17 (FIG. 1)
29 second arm of 22, working arm for 18 (FIG. 2)
30 damping mechanism
31 elastomeric element, flexible bar
32 free projecting section of 32, section of the bar
33 mounting section of 31 (FIG. 2)
34 bar headpiece on 33 (FIG. 2)
35 projection on 17 for 33 (FIG. 2)
36 slot between projections 35 (FIG. 2)
37 free end of 32
38 arch of 32 (FIG. 1)

39 return path of 21, 37, return movement (FIG. 2)
40 L-shaped opposing surface
41 stop section of 40
42 bending section of 40
43 torsion spring for 25, 26 (FIGS. 3, 4)
44 through-opening in 10 (FIGS. 3, 4)
45 shell part on 10 (FIGS. 3, 4)
46 cut-out in 42 (FIGS. 2, 4)

The invention claimed is:

1. A device for actuating a lock of a door or hatch of a vehicle, comprising:

a stationary bracket on the door or hatch;

a movable unit, including a handle manually accessible from the exterior of the door, which is pivotably supported on the bracket, wherein actuation of the handle in turn actuates the lock, the movable unit including a reversing lever;

spring-loading, which holds the unactuated movable unit in a defined rest position on the bracket, and wherein upon actuation of the handle, the movable unit is actuated and capable of being pivoted together with the reversing lever against the spring-loading into a working position; and a damping mechanism, which slows down the return pivoting movement of the movable unit, wherein an elastomeric element is seated in at least one location on the movable unit and pivots along with the unit when the handle is actuated;

a free section of the elastomeric element projects out from the movable unit;

a stationary opposing surface on the bracket is arranged to cooperate with the projecting free section; wherein the free section is configured and the opposing surface placed in a position in a return path of the movable unit so that, with actuation of the handle, the free section strikes the opposing surface and begins to undergo deformation while the return movement is still in progress;

the kinetic energy of the movable unit is substantially absorbed by the work of deformation of the free section by the time the unit reaches its rest position; and in the rest position, the deformed free section is supported against the opposing surface of the bracket.

2. A device according to claim 1, wherein the elastomeric element consists of a flexible bar; and in the rest position of the movable unit, the opposing surface bends the flexible bar.

3. A device according to claim 2, wherein the flexible bar is bent every time it approaches the rest position.

4. A device according to claim 2, wherein the profile of the flexible bar varies in the longitudinal direction.

5. A device according to claim 3, wherein the opposing surface is L-shaped, consisting of a stop section, against which the free section of the bar comes to rest when in the rest position, and of a bending section, which is at an angle to the first section and serves to deform the free section of the bar; and in the rest position of the movable unit, a free end of the bar is bent-over and rests on the bending section, whereas the bent-over free end of the bar forms an arch in the bar that rests against the stop section.

6. A device according to claim 1;

wherein the elastomeric element is seated on the reversing lever of the movable unit; and the reversing lever transmits the pivoting actuation of the handle to the lock utilizing an element.

7. A device according to claim 6, wherein the reversing lever has a ballast arm with a counterweight; and the elastomeric element is seated on the ballast arm.

8. A device according to claim 7, wherein the ballast arm has a slot, which serves as a seat for a mounting section of the elastomeric element.

9. A device according to claim 8, wherein the slot is located on the counterweight of the ballast arm.

10. A device according to claim 9, wherein the counterweight is provided with two projections, which are essentially axially parallel to the reversing lever and which form the slot between them.

11. A device according to claim 10, wherein the elastomeric element has an expanded headpiece on the mounting section, which facilitates the mounting of the elastomeric element; and after mounting, the headpiece is supported against the contact surfaces of the two projections.

12. A device according to claim 5, further comprising a shell part, the interior of which forms the opposing surface for the elastomeric element, is formed on the bracket.

13. A device according to claim 12, wherein the bottom of the shell forms the stop section of the L-shaped opposing surface, where one of the edges of the shell functions as the bending section.

14. A device according to claim 12, wherein the elastomeric element has an edge profile, and the sidewall producing the bending section of the L-shaped opposing surface has a cut-out, in which the bent-over end of the elastomeric element comes to rest when the movable unit is in the rest position.

* * * * *